US005487504A

United States Patent [19]

Baird

[11] Patent Number: 5,487,504

[45] Date of Patent: Jan. 30, 1996

[54] PAPERBOARD TRAY AND COVER ASSEMBLY

[75] Inventor: William J. Baird, Indianapolis, Ind.

[73] Assignee: Inland Container Corporation, Indianapolis, Ind.

[21] Appl. No.: 279,914

[22] Filed: Jul. 25, 1994

[51] Int. Cl.[6] ..... B65D 25/04

[52] U.S. Cl. ..... 229/120.17; 229/120.18; 229/164; 229/191

[58] Field of Search ..... 229/120.08, 120.17, 229/120.18, 164, 191, 919

[56] References Cited

U.S. PATENT DOCUMENTS

| | | | |
|---|---|---|---|
| 1,601,957 | 10/1926 | Gaylord . | |
| 1,808,922 | 6/1931 | Gallistel | 229/120.18 |
| 2,578,774 | 12/1951 | Belsinger | 229/120.18 |
| 3,616,986 | 11/1971 | Wolfe et al. . | |
| 3,734,389 | 5/1973 | Brown . | |
| 3,982,682 | 9/1976 | Fremion . | |
| 4,192,443 | 3/1980 | McLaren | 229/120.17 X |
| 4,427,108 | 1/1984 | Coles et al. . | |
| 4,519,538 | 5/1985 | Omichi | 229/120.17 X |
| 4,676,429 | 6/1987 | Crowe et al. | 229/120.18 X |
| 4,807,804 | 2/1989 | Schwaner et al. . | |
| 5,333,777 | 8/1994 | Roth | 229/191 X |
| 5,372,299 | 12/1994 | Edgerton, Jr. et al. | 229/120.18 |

FOREIGN PATENT DOCUMENTS

| | | | |
|---|---|---|---|
| 4017399 | 12/1991 | Germany | 229/120.17 |
| 653178 | 10/1977 | U.S.S.R. . | |

*Primary Examiner*—Allan N. Shoap
*Assistant Examiner*—Christopher McDonald
*Attorney, Agent, or Firm*—Fitch, Even, Tabin & Flannery

[57] ABSTRACT

A paperboard tray is provided with sidewalls forming a T-shaped beam. Optional corner posts may be provided to further increase the stacking strength of the tray. An optional cover may also be employed to provide a sealed container assembly.

21 Claims, 8 Drawing Sheets

PAPERBOARD TRAY AND COVER ASSEMBLY

BACKGROUND OF THE INVENTION

1. Field of the Invention

The present invention pertains to paperboard packaging, and in particular to trays made of paperboard material, including trays having a cover to form an enclosed container.

2. Description of the Related Art

In the past, individual items of manufacture, even when shipped in significant numbers, have had individual packaging which is then inserted in a or other common outer container. In an effort to reduce packaging costs, manufacturers have considered eliminating individual packaging, relying on the common, outer package to protect the contents during shipment. Accordingly, interest has arisen in packaging components such as trays having increased strength.

SUMMARY OF THE INVENTION

It is an object of the present invention to provide a tray, and a packaging container including a tray and a cover, having improved strength characteristics with minimal increase in container weight.

Another object of the present invention is to provide packaging items of the above-described type which are suitable for use with a wide variety of products. For example, the products could be very light weight and have little or no resistance to pressure (such as bags of potato chips). Other types of delicate products (e.g., glass bottles) may be relatively heavy and offer very good resistance to pressure, but may be subject to breakage when subjected to an impulse-type blow. An object of the present invention is to provide packaging items of the above-described type which are suitable for use with these and other types of delicate products.

These and other objects of the present invention which will become apparent from studying the appended description and drawings are provided in a tray of paperboard material made from an integral, one-piece blank, comprising:

a floor;

front and rear walls upwardly extending from opposite ends of the floor;

opposed sidewall panels between the front and rear walls, upwardly extending from the floor, above the front and rear walls;

vertical beam members extending from the sidewall panels toward one another and cooperating with the sidewall panels to form sidewalls of generally T-shaped cross section.

DETAILED DESCRIPTION OF THE PREFERRED EMBODIMENTS

Figure 1:
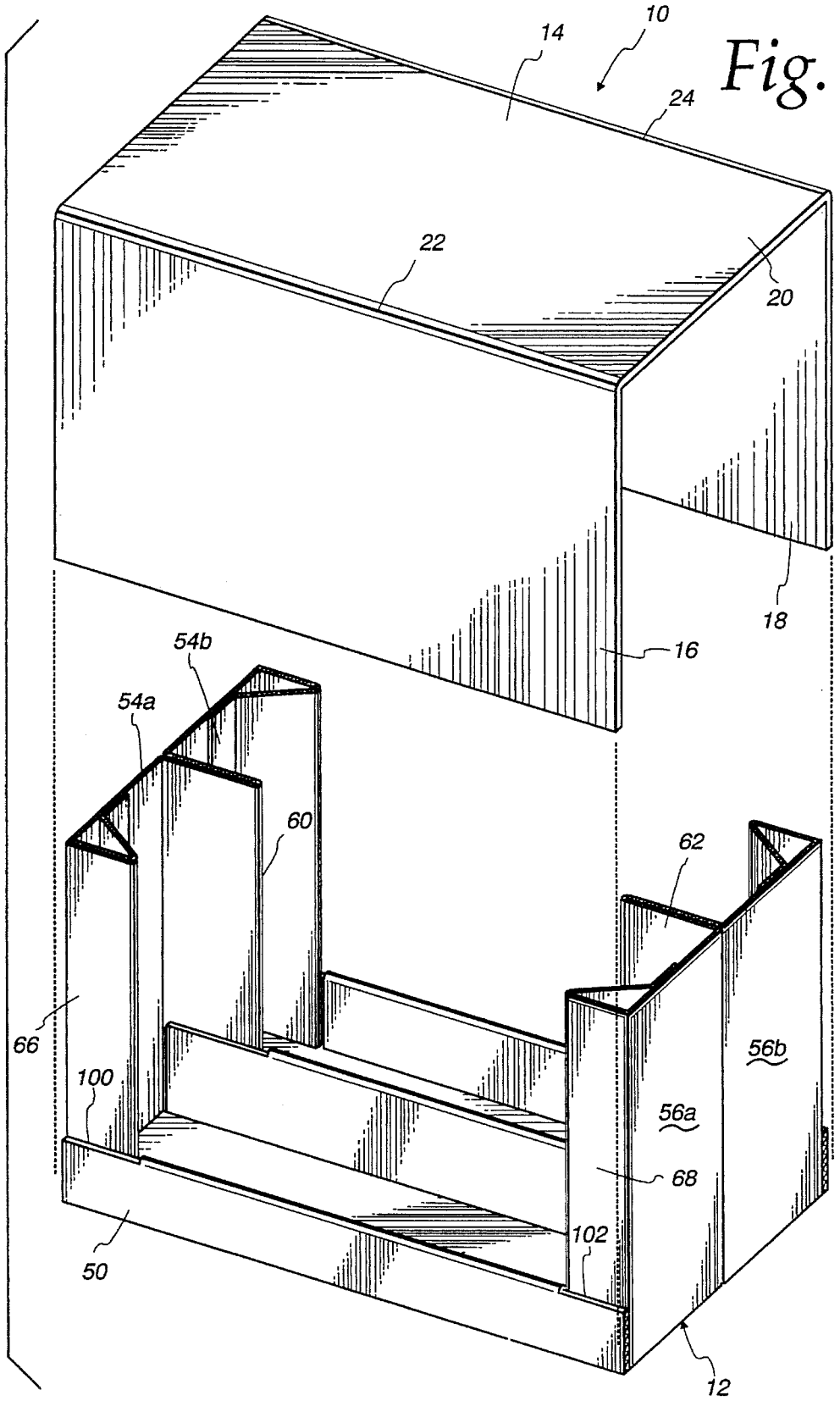
FIG. 1 is an exploded perspective view of a container assembly illustrating principles according to the present invention.

Referring now to the drawings, and initially to FIG. 1, a container assembly is generally indicated at 10. The container assembly includes a tray generally indicated at 12 and a cover 14. The tray 12 is preferably formed from an integral one-piece blank (shown in FIG. 9). The tray 12 is shown in a dual compartment configuration, although the tray can also be configured to have a single compartment or alternatively three or more compartments. The cover 14 is also preferably formed (i.e., without flutes) from a single sheet of paperboard material, such as liner board or corrugated board. The cover could also be formed from plastics or other suitable material, if desired. In a preferred embodiment, the tray 12 and cover 14 are of rectangular construction, with the cover 14 including opposed sidewalls 16, 18 joined by an intermediate top wall 20. The sidewall 16 and top wall 20 are preferably joined by a fold line 22 while the sidewall 18 and cover 20 are joined by a parallel fold line 24.

Turning now to FIGS. 2–8, the tray 12 includes first and second compartments 30, 32 of substantially identical construction, except for the lower divider wall, as will be explained herein. The tray 12 includes a floor generally indicated at 40, preferably formed of a single paperboard panel which is folded in the middle to form a divider wall 42, located between floor sections 44, 46. Upstanding front and rear lower walls 50, 52 extend generally parallel to divider wall 42.

Tray 12 further includes multisection sidewalls 54, 56. The sidewall 54 includes sidewall sections **54*a*, 54*b* extending generally parallel to one another and preferably lying in a common plane. Similarly, the sidewall 56 is comprised sidewall sections 56*a*, 56*b*, which are also arranged coplanar to one another. Upstanding divider walls or central beams 60, 62 are generally parallel to one another, lying in generally coplanar relationship with the lower divider wall 42 (see FIG. 5). The central beams 60, 62 preferably comprise folded portions of a paperboard blank located between the sidewall sections integrally formed therewith to comprise, in effect, a T-shaped beam. Upstanding forwardly facing front panels 66, 68 extend from sidewalls 54, 56, respectively, and are preferably arranged generally coplanar with lower wall 50. Similarly, upstanding rearwardly facing rear panels 70, 72 are arranged generally coplanar with lower wall 52**.

Figure 2:
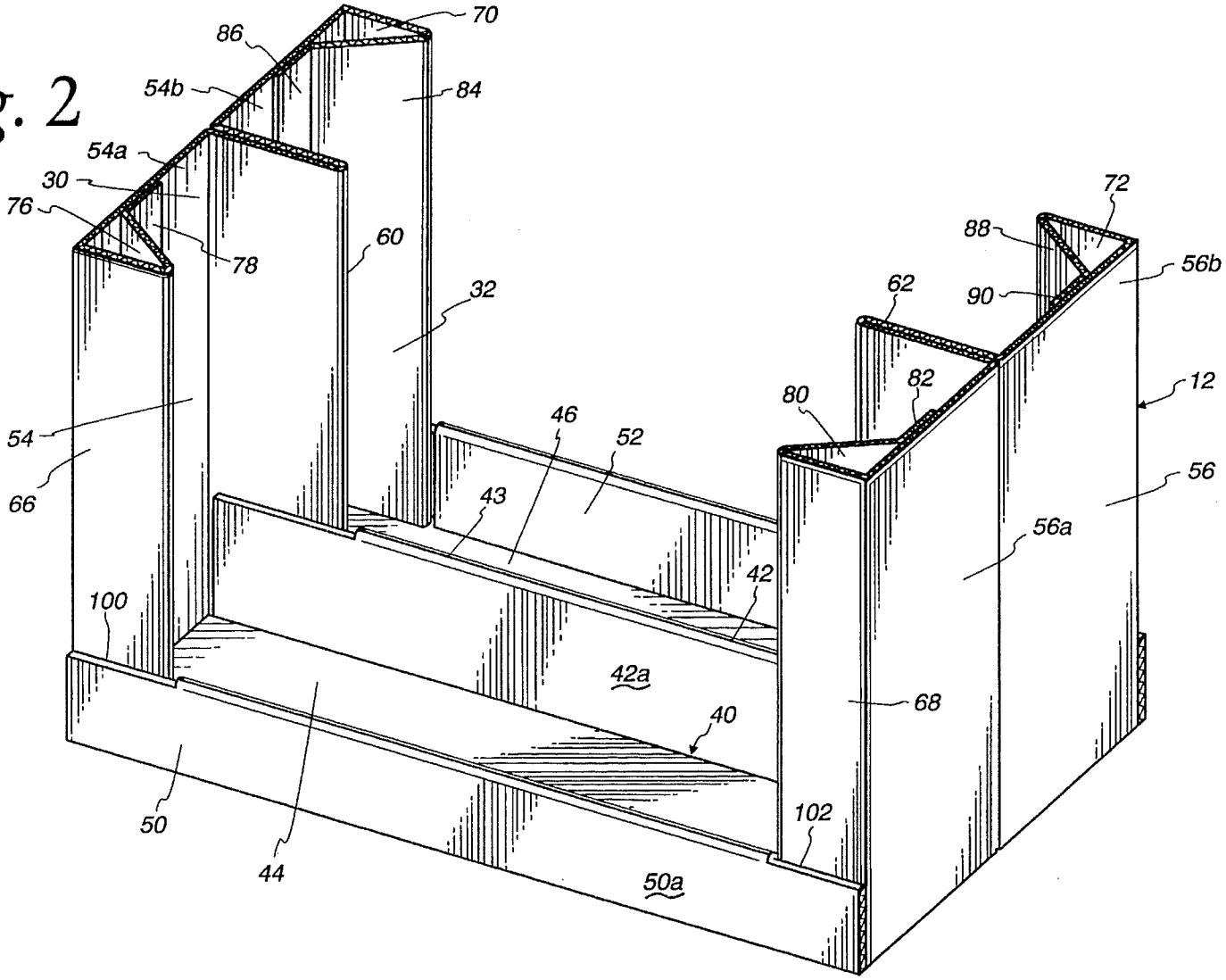
FIG. 2 is a perspective view of the tray member shown above.
Figure 5:
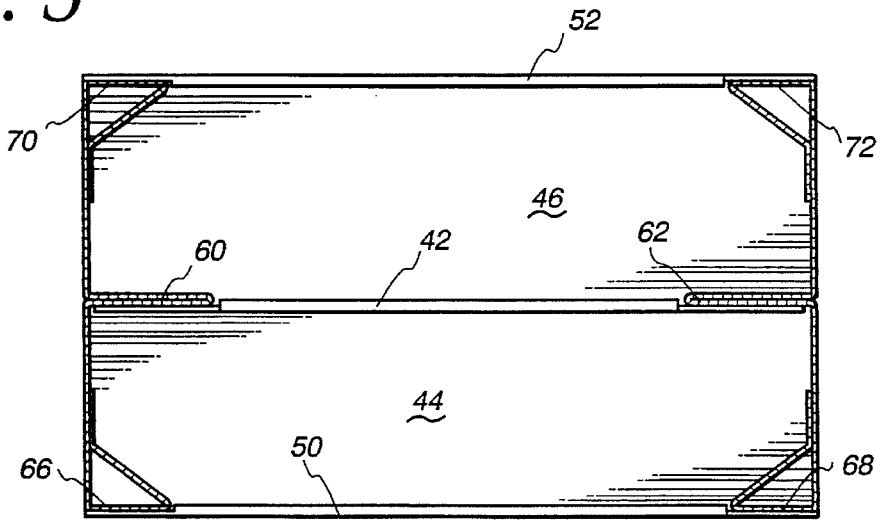
FIG. 5 is a top plan view thereof.
Figure 6:
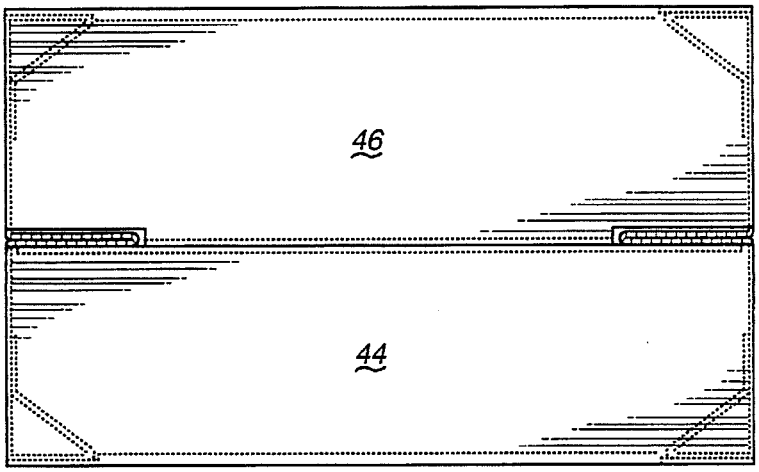
FIG. 6 is a bottom plan view thereof.
Figure 7:
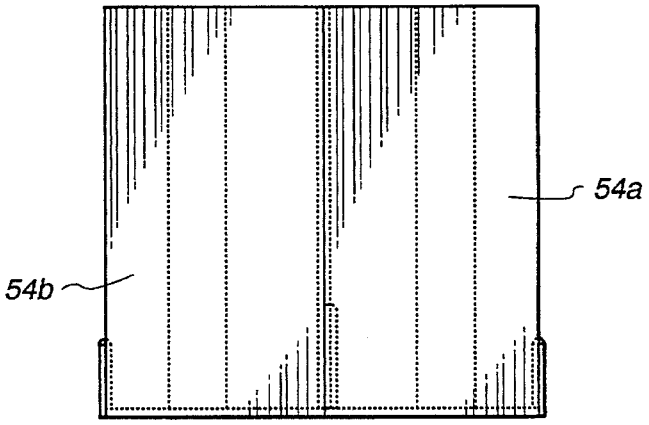
FIG. 7 is an end view from the right hand side of FIG. 2.
Figure 8:
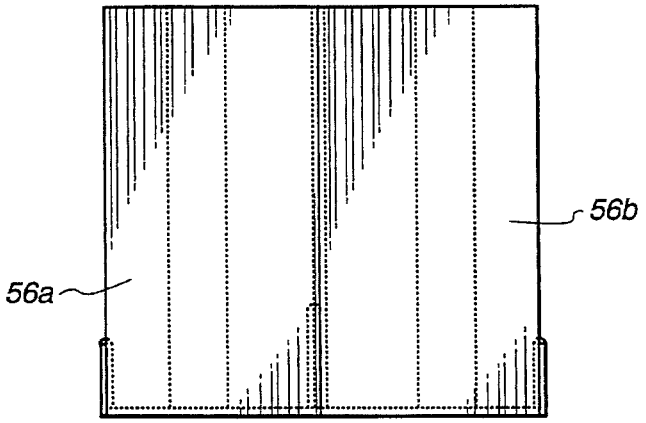
FIG. 8 is an end view from the left hand side of FIG. 2.
Figure 10:
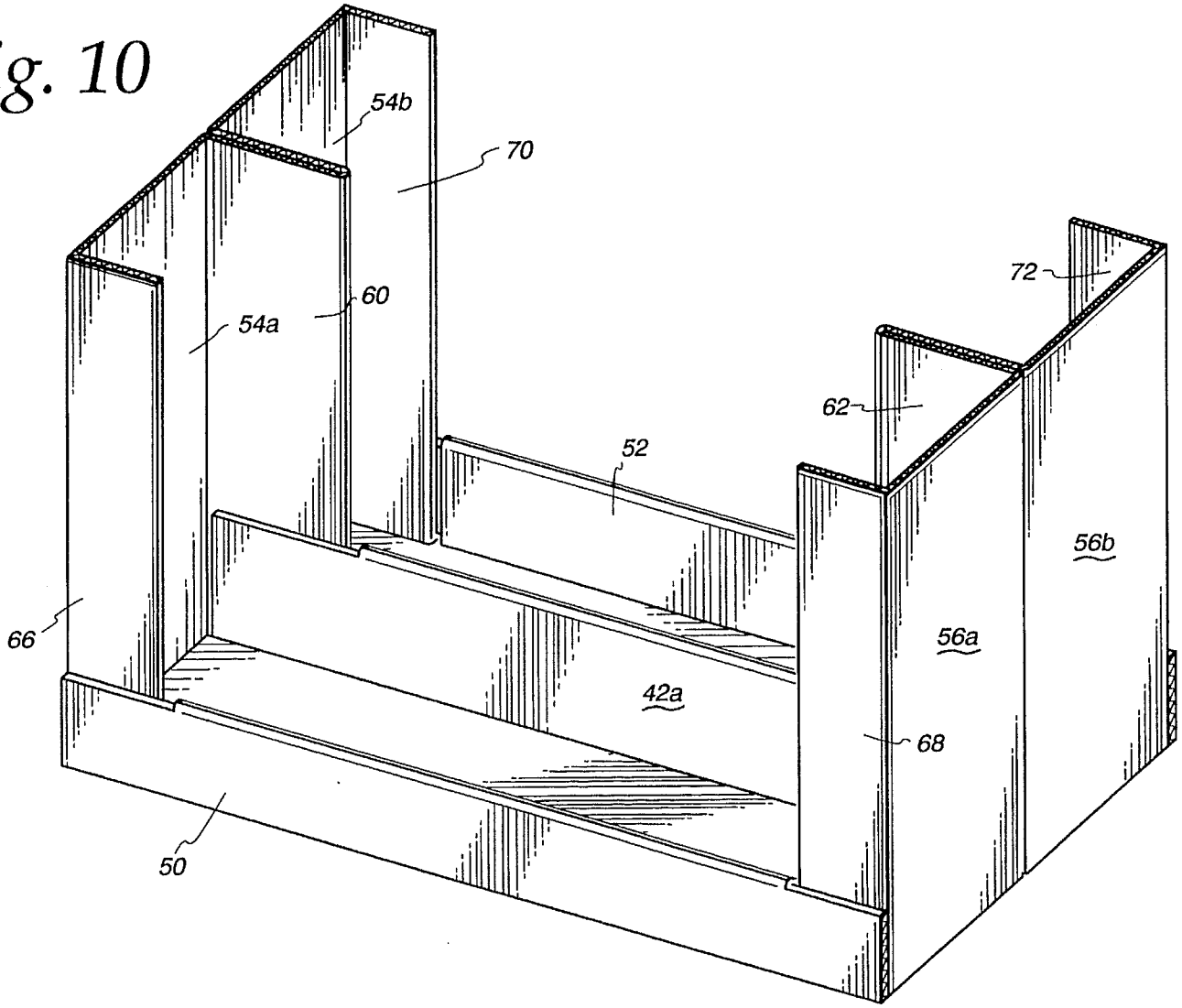
FIG. 10 is a perspective view of an alternative tray construction.
Figure 11:
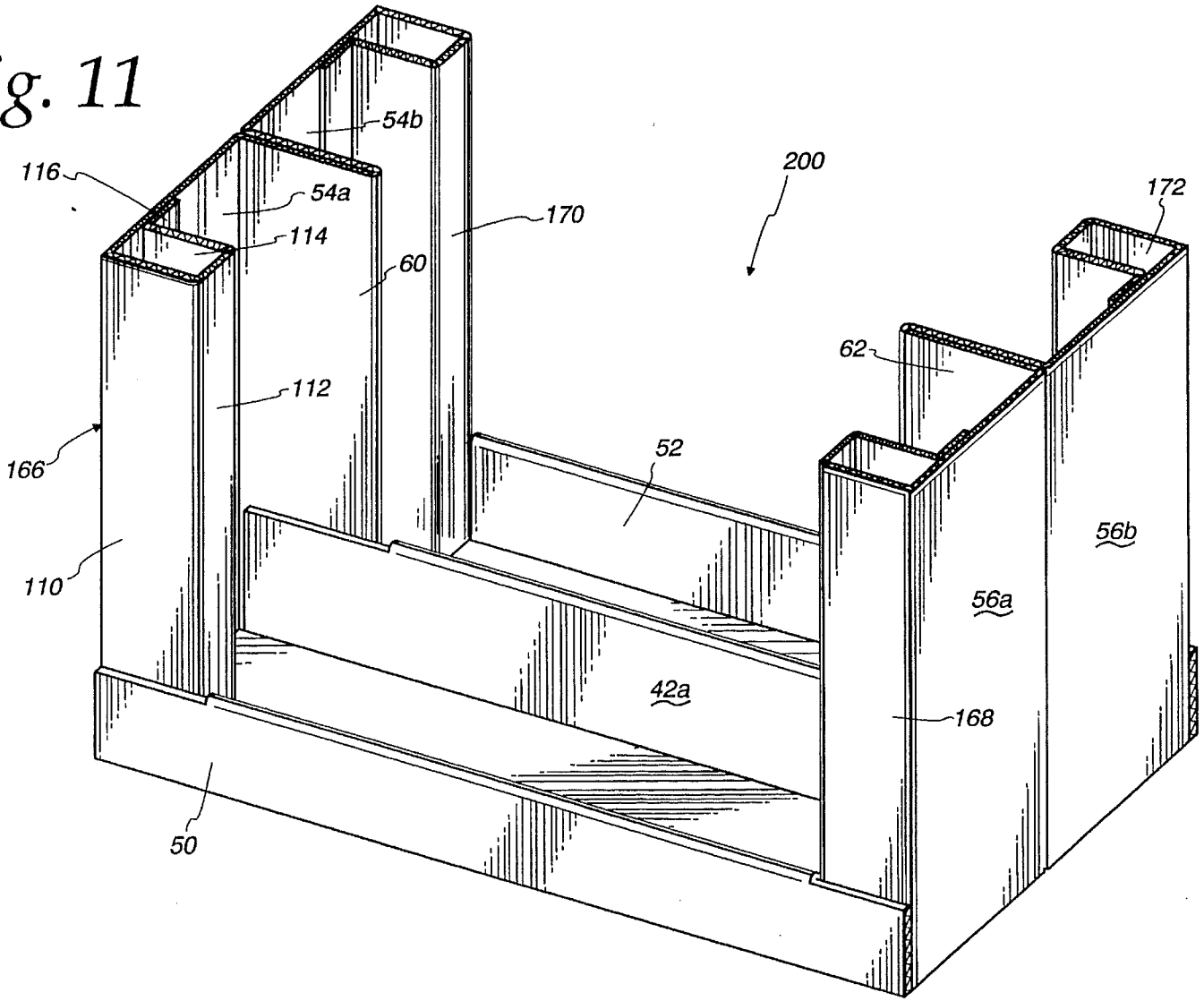
FIG. 11 is a perspective view of an alternative embodiment of a tray member illustrating principles of the present invention.
Figure 12:
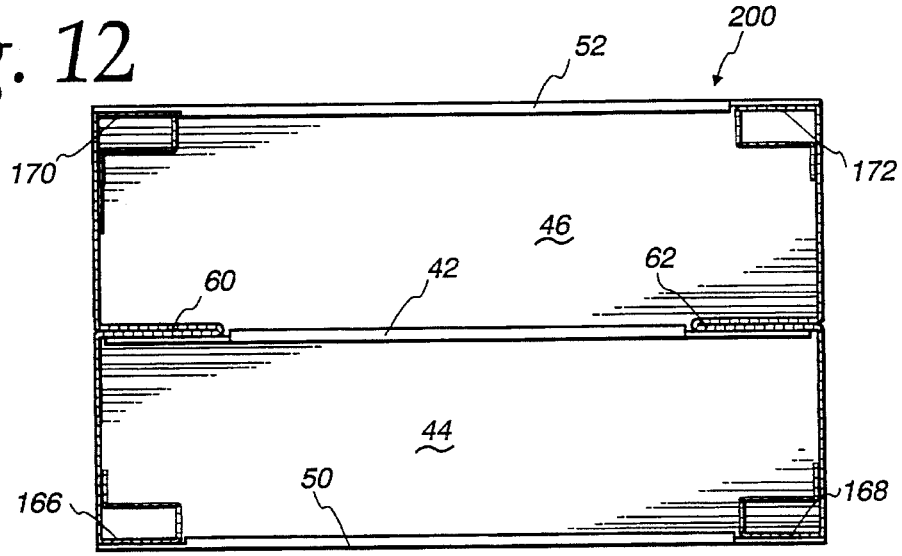
FIG. 12 is a top plan view thereof.
Figure 13:
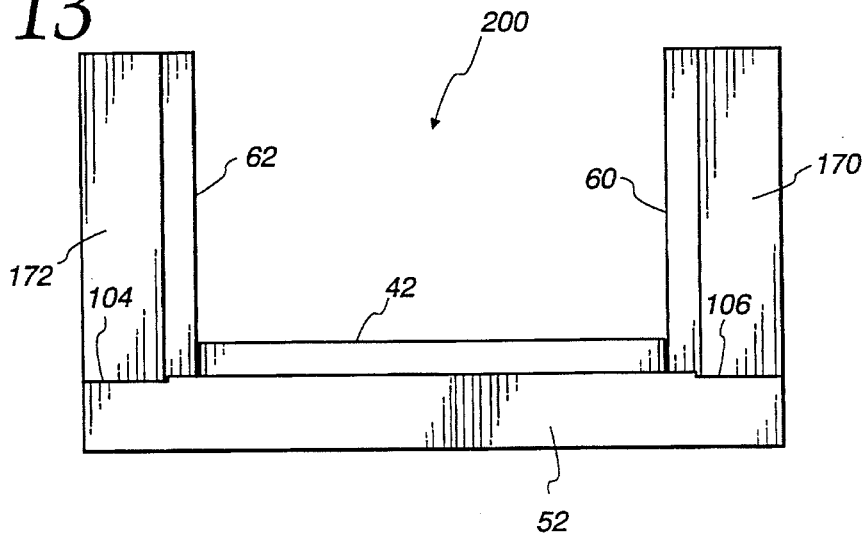
FIG. 13 is a rear elevational view thereof.
Figure 14:
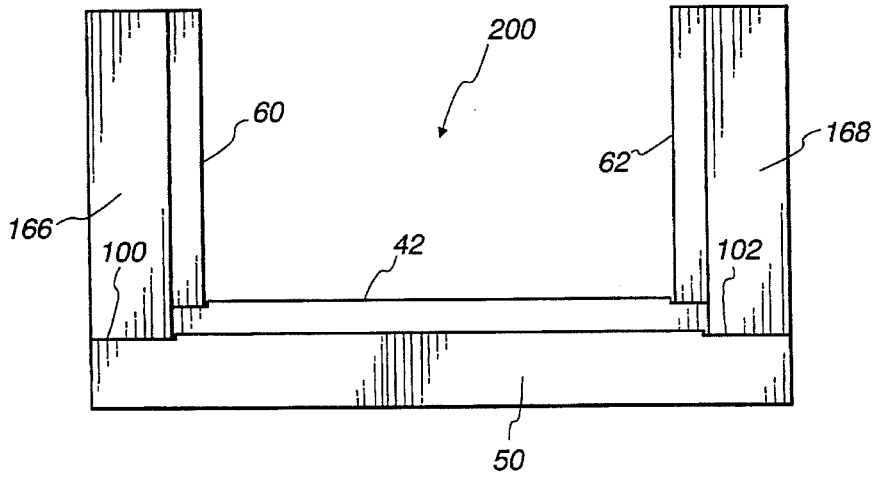
FIG. 14 is a front elevational view thereof.

In the preferred embodiment of tray 12 shown in FIG. 2, a corner post comprising corner panels 76, 78 cooperate with front wall 66 and sidewall **54*a* to form an open channel of generally triangular cross section, as can be seen, for example, in FIG. 5. Similarly, corner post panels 80, 82 cooperate with upstanding sidewall 68 and sidewall section 56*a* to form a corner post having a hollow, triangular cross section. Panels 84, 86 cooperate with rear panel 70 and sidewall section 54***b* to form a corner post, also of generally hollow, triangular cross section. Finally, corner brace panels 88, 90 cooperate with rear panel 72 and sidewall section 56*b* to form a corner post of hollow, triangular cross section. If desired, the corner post pairs 76, 78; 80, 82; 84, 86; and 88, 90 can be omitted, if desired, as shown in FIG. 10. Other alternative embodiments will be discussed below with reference to FIGS. 11–14, directed to a tray having hollow, rectangular tubular corner posts. As will be appreciated by those skilled in the art, the corner posts formed at each corner of tray 12 contribute significantly to the stacking strength of the tray and can readily support relatively heavy weights placed on top of the tray. The central beams 60, 62 also function as post members, contributing significantly to the stacking strength of the tray sidewalls.

As shown in the Figures, the upstanding sidewalls, corner posts and center beam constructions preferably terminate in an upper, common plane, so as to provide a convenient supporting surface, either for the optional cover 14, or for other items such as other cartons stacked on top of tray 12. As mentioned above, it is desirable that a container be able to accommodate a wide variety of products. As will be seen herein, the tray of the present invention can be readily modified to accommodate products of different proportions.

Figure 3:
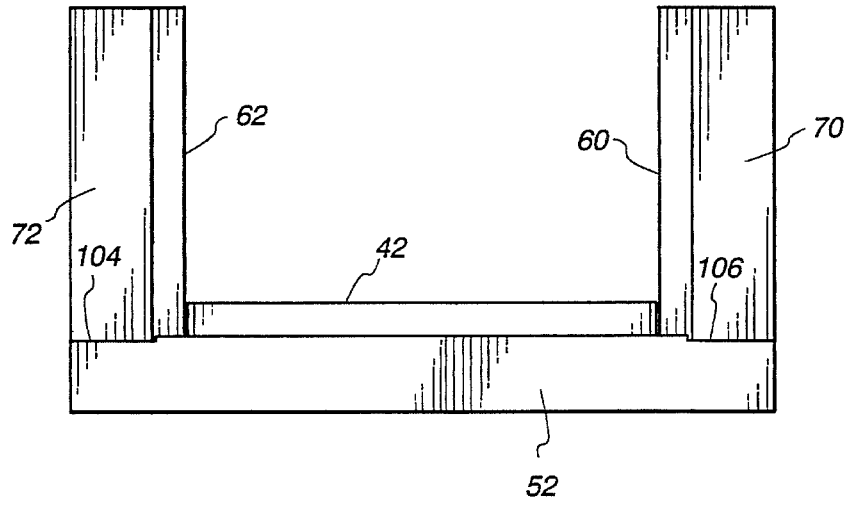
FIG. 3 is a front elevational view thereof.
Figure 4:
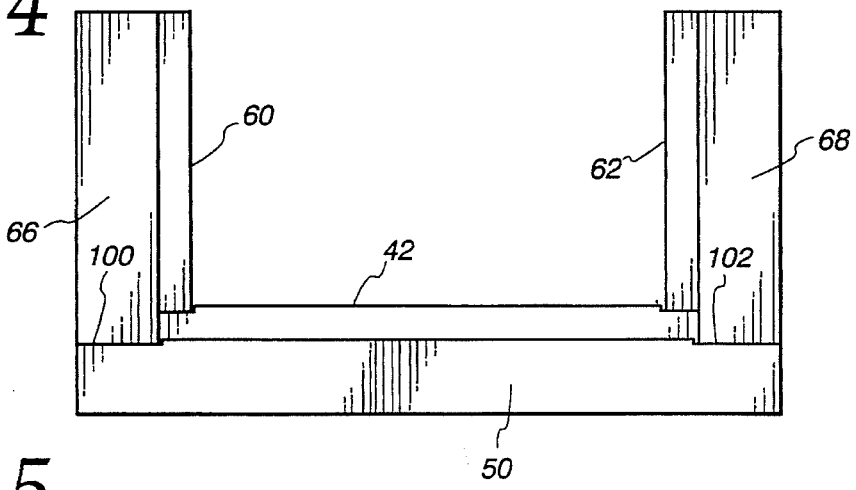
FIG. 4 is a rear elevational view thereof.

For example, the sidewalls, corner posts and center beams can be extended considerably beyond the height shown in FIGS. 3 and 4, for example, without requiring heavier gauge paperboard to maintain a desired stacking strength. Thus, the same tray can be extended in height to accommodate products such as glass bottles which have a height much greater than their cross-sectional dimensions, allowing the bottles to stand upright within the tray. Also, the same tray can be modified to accommodate different packaging configurations for a product. For example, a tray with relative short sidewalls can be used for small lunch box-sized bags of potato chips, for example, with several such packs being loaded in each compartment of the tray. The same tray can be modified to have sidewalls of extended height so as to accommodate a single family-size package of potato chips in each compartment. The design for these two trays can be made virtually identical, except for a change in the sidewall height. A substantial cost savings to a carton manufacturer can be enjoyed with the present invention.

As can be seen from examining the preferred embodiments shown in the Figures, the trays of the present invention provide an attractive display. For example, the optional cover 14 can be provided for shipment to prevent dust intrusion to the interior of the tray. Upon arrival at a store, the cover 14 can be removed with the tray 12 ready to be placed on a shelf, making an attractive presentation of products carried inside the tray. Further, the front and rear walls help to maintain contents of the tray in a desired upright orientation, thus conserving shelf space, especially for products such as small bags of potato chips which are not self standing.

Preferably, the floor sections 44, 46, interior wall 42 and the front and rear walls 50, 52 are formed from a continuous strip of corrugated material which is folded several times to form the three upstanding walls 42, 50, 52. Each of these upstanding walls 42, 50 and 52 are of double thickness construction. As can be seen in FIGS. 1 and 2, for example, the front wall 50 has cut edges 100, 102 which are upwardly facing, lying on an outside surface of the front panels 66, 68, respectively. The cut edges 100, 102 provide a convenient stop surface for the bottom edges of cover sidewalls 16, 18 to form a dust-tight package with top wall 20 of cover 14 engaging the upper edges of the tray to prevent collapse of an improperly positioned cover top wall and to maintain an attractive appearance of the covered tray package during transit. Cut edges 104, 106 are similarly formed on the ends of lower rear wall 52. If desired, package tape can be applied over the butt seam formed between the bottom edge of the cover sidewalls and the upper edges of tray walls 50, 52. With the preferred construction of the tray walls 50, 52, only a single paperboard layer protrudes beyond the common plane formed by the front surfaces of upstanding panels 66, 68. It is preferred that cover 14 be made of a single layer of paperboard material, and accordingly, with the cover mated to tray 12, the resulting package is provided with smooth front and rear surfaces.

Figure 9:
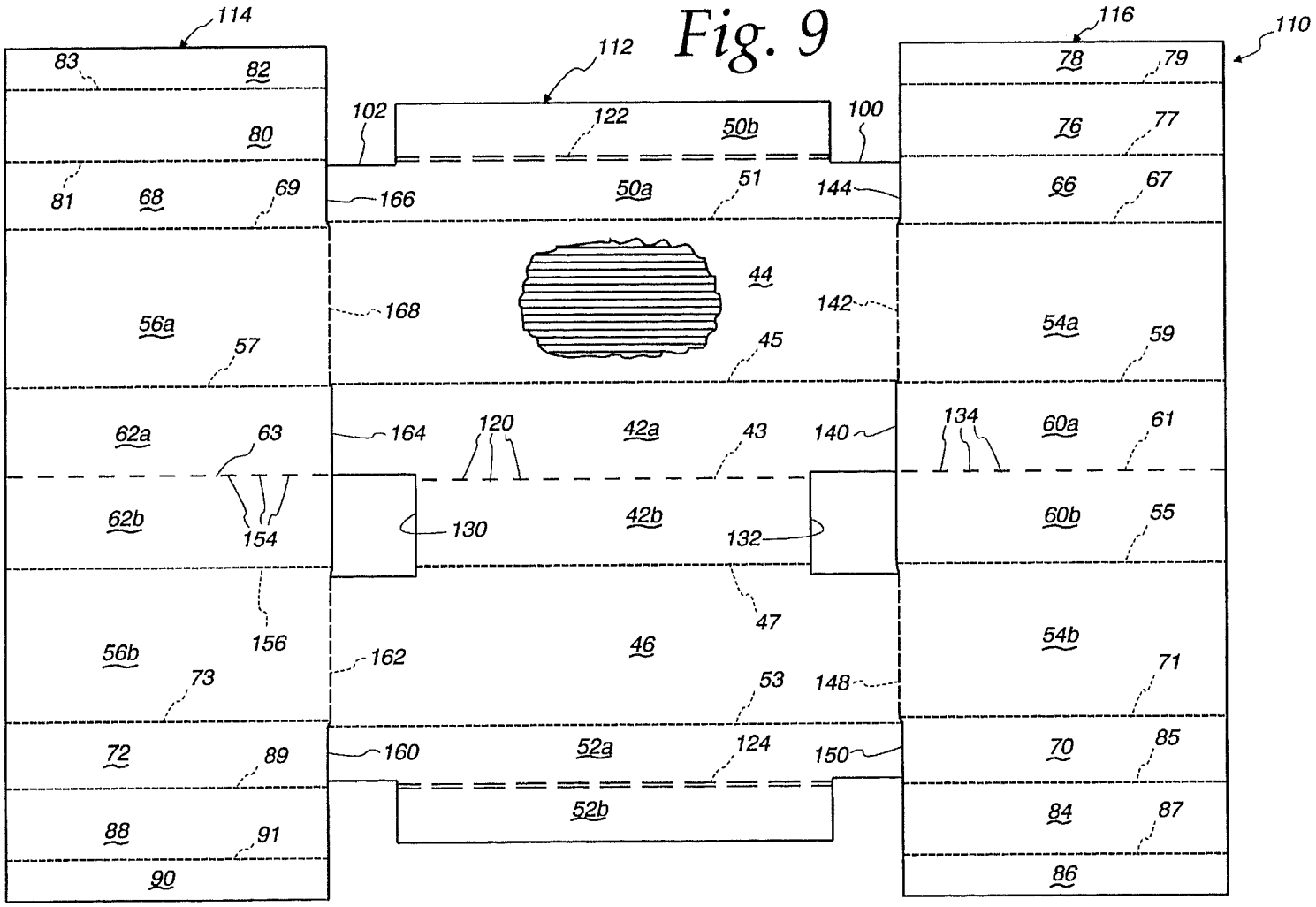
FIG. 9 is a top plan view of a paperboard blank from which the tray of FIG. 2 is formed.

Turning now to FIG. 9, a paperboard blank is generally indicated at 110. The carton blank 110 includes a central column 112 located between outer columns 114, 116. Generally speaking, the floor sections and upstanding walls 42, 50, 52 are formed from the center column 112, while the sidewalls, center beams and corner posts are formed from the outer columns 114, 116. The inside surfaces of tray 12 are visible in FIG. 9.

The central column 112 of blank 110 includes a centerline (which is also, preferably, a line of symmetry) comprising fold line 43 joining adjacent divider panels 42*a*, 42*b* and including a series of perforations 120 to aid in folding. The perforations 120 have been omitted in the other figures for clarity of illustration. Panels 42*a*, 44 are joined by a fold line 45, preferably formed by scoring the paperboard blank 110. A fold line 47 joins adjacent panels 42*b*, 46, and is also formed by scoring the paperboard blank. Adjacent panels 44, 50*a* are joined by a fold line 51 formed by scoring blank 110. Front panels 50*a*, 50*b* are joined by a double score line 122. Adjacent panels 46, 52*a* are joined by score-type fold line 53, while adjacent rear wall panels 52*a*, 52*b* are joined by a double score line 124.

In fabricating the tray, fold line 45, 47 are brought together with score line 43 being raised from the plane of blank 110. This brings the hidden underside surfaces of panels 42*a*, 42*b* together, and a suitable adhesive is employed to maintain their abutting joinder. Panel 50*a* is raised out of the plane of blank 110, being folded about fold line 51. The sides of panels 50*a*, 50*b*, visible in FIG. 9, are folded against one another and secured with a suitable adhesive. Similarly, the upper surfaces of panels 52*a*, 52*b* are secured together with adhesive to form upstanding wall 52, which is raised in an upstanding position by folding about line 53. Generally rectangular shaped holes 130, 132 are formed at either end of panel 42*b*. These holes, which also extend slightly into adjacent panels 46, accommodate the central beams 60, 62, so as to minimize thickness variations in the center of the tray (see FIG. 5, for example).

Turning now to the right hand column 116, adjacent panels 60*a*, 60*b* are joined together along perf line 61, which includes a series of spaced perforations 134. Adjacent panels 54*b*, 60*b* are joined together along a fold line 55 while adjacent panels 54*b*, 70 are joined together by a fold line 71. Panels 70, 84 are joined together by a fold line 85, and panels 84, 86 are joined together by a fold line 87. Fold lines 55, 71, 85 and 87 are lined to indicate a preferable construction which includes a larger number of smaller sized perforations to aid in folding. Turning now to the remaining half portion of outer column 116, panels 60*a*, 54*a* are joined together by a fold line 59, while panels 54*a*, 66 are joined together by a perf line 67. Adjacent panels 66, 76 are joined together by a perf line 77, while panels 76, 78 are joined together by a perf line 79.

In the fabrication of tray 12, fold lines 55, 59 are brought together with fold line 61 being raised out of the plane of blank 110, to form center beam wall 60. A cut line 140 divides panels 60*a*, 42*a*. The underside surfaces of panels 60*a*, 60*b* are brought together and secured with a suitable adhesive. Panels 54*a*, 66 are folded at right angles to one another, with panel 66 being raised out of the plane of blank 110. Corner post wall 78 is positioned against sidewall panel 54*a* and secured thereto with a suitable adhesive. Panels 44, 54*a* are joined together by a fold line 142, while panels 50*a*, 66 are separated by a cut line 144. Similarly, the panels 46, 54*b* are joined together by a fold line 148, while the laterally adjacent panels 52*a*, 70 are separated by a cut line 150.

A fold line 61 of outer column 116 preferably comprises a line of symmetry. Accordingly, the bottom half of column 116 is assembled as described above, with corner post wall 86 being pressed against sidewall panel 54*b*, with panel 70 extending at a right angle to panel 54*b*. Preferably, the corner post panel 86 is secured with a suitable adhesive to panel 54*b*.

Outer column 114 preferably comprises a mirror image of outer column 116 and is assembled in a similar manner. The fold line constructions of outer column 114 are similar to those of outer column 116. In particular, panels 62*a*, 62*b* are joined together by a perf line 63, preferably including a series of spaced-apart perf lines 154. Adjacent panels 56*a*, 62*a* are joined together by a perf line 57, preferably comprised of a larger number of smaller perf cuts than line 63. Adjacent panels 56*a*, 68 are joined by a perf line 69, adjacent panels 68, 80 are joined by a perf line 81 and adjacent panels 80, 82 are joined by a perf line 83. Line 63 is preferably a line of symmetry of outer column 114. Panels 56*b*, 62*b* are joined together by a perf line 156, while panels 56*b*, 72 are joined together by a perf line 73, adjacent panels 72, 88 are joined by a perf line 89 and adjacent panels 88, 90 are joined by a perf line 91. Laterally adjacent panels 72, 52*a* are separated by a cut line 160, while laterally adjacent panels 56*b*, 46 are joined by a fold line 162. Adjacent panels 62*a*, 42*a* are separated by a cut line 164, and panels 50*a*, 68 are also separated by a cut line, the cut line 166. Laterally adjacent panels 44, 56*a* are joined by a fold line 168.

During construction, the paperboard blank is folded about the centerlines 63, 43 and 61 and "pinched" so as to raise this fold line out of the plane of the blank. The mating sections on either side of the fold lines 63, 43 and 61 are secured together with a suitable adhesive. The rear panels of the center column, panels 52*a*, 52*b* and 50*a* and 50*b* are secured together with a suitable adhesive. The constructions formed from the outer columns are then raised to generally upright positions, bringing the beams 60, 62 into contact with end portions of panel 42*a*, being secured thereto with a suitable adhesive. The front and rear walls 50, 52 are then raised into position, in contact with lower portions of the panels 66, 68, 70 and 72. The overlapping joinder panel members at the lower corners of the carton are secured with a suitable adhesive. If the corner posts are omitted, as in FIG. 10, construction of the tray is complete. If, however, corner posts are provided, as shown in FIG. 2, for example, panels 78, 82, 86 and 90 are folded against their respective sidewall sections and secured thereto with adhesive, to complete construction of the corner post tray shown in FIG. 2. If desired, the corner posts can be erected and secured to their respective sidewall sections either as a first step in the construction of the tray from the blank 110, or at virtually any point in time thereafter, without interfering with other fabrication steps as explained herein.

As can be seen in FIG. 2, the center beam 62 cooperates with sidewall sections 56*a*, 56*b* to form a T-shaped composite member to support vertical loading. The same is also true of the other side of the tray, which is mentioned above is preferably a mirror image.

As mentioned above, FIG. 10 shows an alternative embodiment of the tray, substantially identical to tray 12 described above, except for the omission of the corner post members. It is generally preferred, however, that the panels 66, 68, 70 and 72 be provided for convenient mating surfaces for the cover and to cooperate with the cover to prevent dust intrusion into the interior of the container assembly. As with tray 12 described above, the tray shown in FIG. 10 can be used without a dust cover. As mentioned above, it is generally preferred that the lower corners of the tray be bonded together with an adhesive, with the panel 50 being secured at its outside ends to panels 66, 68 and with panel 52 being secured at its outside ends to panels 70, 72. When the tray of FIG. 10 is employed without cover 14, then the upper portions of panels 66, 68, 70 and 72 can be omitted, if desired.

Turning now to FIGS. 11–14, an alternative embodiment of a tray constructed according to principles of the present invention is generally indicated at 200. As will be seen herein, tray 200 bears many similarities to the tray member described above with reference to FIGS. 2–8. In tray member 200, corner posts 166–172 are provided in the form of hollow tubular members having rectangular cross section configurations. The corner post 166, for example, has a front face panel 110, an edge face 112, an interior wall 114 and a joining flap 116 secured to sidewall section 54*a* with a suitable adhesive. Preferably, corner post 166 has a generally rectangular cross-sectional configuration with front wall 110 and rear wall 114 spaced apart from one another in generally parallel relationship. The spacing between front and rear walls 110, 114 corresponds generally to the width of edge wall 112. If desired, the width of edge wall 112 can be varied from that shown in FIG. 11, so as to change the spacing between front and rear walls 110, 114. For example, edge wall 112 can be shortened so as to bring front and rear walls 110, 114 into contact with one another. However, it is generally preferred that the front and rear walls be joined by generally right angle corners and not rounded, (as shown, for example, central beams 60, 62. In the preferred embodiment, the remaining three corner posts 168, 170 and 172 are formed substantially identical to corner post 166, although the corner posts of a particular tray member need not have identical configurations in all instances.

The uses for trays and tray assemblies constructed according to principles of the present invention are presented here by way of example only, and not limitation. From studying the above, it will be readily appreciated that trays and tray assemblies constructed according to principles of the present invention can be employed with a wide variety of objects, including mass produced commercial products. Further, the trays and tray assemblies can be used in combination with a plastic overwrap.

In the preferred embodiments described above, the trays are preferably formed from a single unitary sheet of paperboard, most preferably double-faced corrugated board. However, the trays and tray assemblies according to principles of the present invention could be formed from different types of paperboard materials, such as liner board (material which does not have corrugations or flutes). It may be desirable in certain applications that the paperboard blank be reinforced with additional layers of paper products or plastics materials. For example, the outside corners of the tray could be reinforced with stripes of plastic material bonded to the paperboard blank during manufacture of the tray.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A tray of paperboard material made from an integral, one-piece blank, comprising:

a floor having a midportion formed of at least two layers folded against one another to form an upstanding divider wall, integrally formed with the floor and dividing the floor into two portions;

front and rear walls upwardly extending from opposite ends of the floor;

opposed sidewall panels between the front and rear walls, upwardly extending from the floor, above the front and rear walls;

vertical beam members formed of at least two layers integrally formed with the sidewall panels and folded against one another with a fold line extending upwardly from the floor so as to outwardly extend from the sidewall panels toward one another and cooperating with the sidewall panels to form sidewalls of generally T-shaped cross section, the folded portions extending upwardly from the floor along the sidewall panels; and the vertical beam members located at opposing ends of the divider wall.

2. The tray of claim 1 wherein the midportion comprises overlapping panels adhesively bonded to one another.

3. The tray of claim 2 wherein the midportion is arranged in generally coplanar aligned with the vertical beam members.

4. The tray of claim 1 wherein the front and rear walls are generally planar, the tray further comprising a front and a rear panel extending from opposed ends of each sidewall panel, in coplanar relationship with the front and rear walls, respectively.

5. The tray of claim 4 further comprising corner posts extending from opposed ends of each sidewall panel.

6. The tray of claim 5 wherein the corner posts comprise corner post panels extending from the front and the rear panels, respectively, with one corner post panel joined to an adjacent sidewall panel.

7. The tray of claim 6 wherein the corner post panels cooperate with the front and the rear panels and the sidewall panels to form hollow tubes of generally triangular cross section.

8. The tray of claim 6 wherein the corner post panels cooperate with the front and rear panels and the sidewall panels to form hollow tubes of generally rectangular cross section.

9. A container assembly comprising:

a tray of paperboard material made from an integral, one-piece blank, including a floor having a midportion formed of at least two layers folded against one another to form an upstanding divider wall, integrally formed with the floor and dividing the floor into two portions, front and rear walls upwardly extending from opposite ends of the floor, opposed sidewall panels between the front and rear walls which extend upwardly from the floor above the front and rear walls, vertical beam members integrally formed of at least two layers integrally formed with the sidewall panels and folded against one another with a fold line extending upwardly from the floor so as to outwardly extend from the sidewall panels toward one another and cooperating with the sidewall panels to form sidewalls of generally T-shaped cross section, the folded portions extending upwardly from the floor along the sidewall panels, and the vertical beam members located at opposing ends of the divider wall;

the sidewall panels and vertical beams having respective upper ends; and a cover of paperboard material made from an integral, one-piece blank, including a first wall adjacent the front wall of the tray and a second wall adjacent the rear wall of the tray, and a top wall adjacent the upper ends of the sidewall panels and vertical beams.

10. The assembly tray of claim 9 wherein the midportion comprises overlapping panels adhesively bonded to one another.

11. The assembly tray of claim 9 wherein the midportion is arranged in generally coplanar aligned with the vertical beam members.

12. The assembly tray of claim 9 wherein the front and rear walls are generally planar, the tray further comprising a front and a rear panel extending from opposed ends of each sidewall panel, in coplanar relationship with the front and rear walls, respectively, with the first and second panels of the tray mating with the front and rear walls of the cover.

13. The assembly tray of claim 12 further comprising corner posts extending from opposed ends of each sidewall panel, the corner posts having upper ends adjacent the top wall of the cover.

14. The assembly tray of claim 13 wherein the corner posts comprise corner post panels extending from the front and the rear panels, respectively, with one corner post panel joined to an adjacent sidewall panel.

15. The assembly tray of claim 14 wherein the corner post panels cooperate with the front and the rear panels and the sidewall panels to form hollow tubes of generally triangular cross section.

16. The assembly of claim 14 wherein the corner post panels cooperate with the front and rear panels and the sidewall panels to form hollow tubes of generally rectangular cross section.

17. A blank made from an integral, single piece of paperboard material which is folded to form a tray including a floor, front and rear walls upwardly extending from opposite ends of the floor, opposed sidewall panels between the front and rear walls which extend upwardly from the floor above the front and rear walls, and vertical beam members extending from the sidewall panels toward one another and cooperating with the sidewall panels to form sidewalls of generally T-shaped cross section, the blank comprising:

two outer columns comprising mirror images of one another;

a central column between the two outer columns;

the central column comprising a serial succession of at least one front panel, a first floor panel, a first center divider panel, a second divider panel, a second floor panel and at least one rear panel;

the outer columns each comprising a serial succession of a forwardly facing panel, a first sidewall panel, a first vertical beam panel, a second vertical beam panel, a second sidewall panel and a rearwardly facing panel;

the first and the second divider panels joined together by a first fold line, and the first and the vertical beam panels joined together by a second and a third fold line, respectively, lying on opposite ends of the first fold line in generally colinear relationship therewith; and the two outer columns joined to the central column by respective fold lines so that the first and second sidewall panels are connected to the first and second floor panels by the fold lines.

18. The blank of claim 17 wherein the second divider panel has opposed ends, located laterally adjacent but spaced from the second beam panels of the outer columns, so as to cooperate with the second floor panels to form apertures in the blank.

19. A tray of paperboard material made from an integral, one-piece blank, comprising:

a floor;

front and rear walls upwardly extending from opposite ends of the floor;

opposed sidewall panels between the front and rear walls, upwardly extending from the floor, above the front and rear walls;

vertical beam members extending from the sidewall panels toward one another and cooperating with the sidewall panels to form sidewalls of generally T-shaped cross section;

the vertical beam members comprising outwardly folded portions of paperboard material forming the sidewall panels; and the floor having a midportion folded to form an upstanding divider wall, dividing the floor into two portions, with the midportion comprising overlapping panels adhesively bonded to one another.

20. The tray of claim 19 wherein the midportion is arranged in generally coplanar aligned with the vertical beam members.

21. A container assembly comprising:

a tray of paperboard material made from an integral, one-piece blank, including a floor, front and rear walls upwardly extending from opposite ends of the floor, opposed sidewall panels between the front and rear walls which extend upwardly from the floor above the front and rear walls, and vertical beam members extending from the sidewall panels toward one another and cooperating with the sidewall panels to form sidewalls of generally T-shaped cross section;

the sidewall panels and vertical beams having respective upper ends;

a cover of paperboard material made from an integral, one-piece blank, including a first wall adjacent the front wall of the tray and a second wall adjacent the rear wall of the tray, and a top wall adjacent the upper ends of the sidewall panels and vertical beams;

the vertical beam members comprising outwardly folded portions of paperboard material forming the sidewall panels; and the floor having a midportion folded to form an upstanding divider wall, dividing the floor into two portions, with the midportion comprising overlapping panels adhesively bonded to one another.

* * * * *